US008248318B2

(12) United States Patent
Wahlberg et al.

(10) Patent No.: US 8,248,318 B2
(45) Date of Patent: Aug. 21, 2012

(54) ANTENNA SYSTEM FOR COMMUNICATIONS ON-THE-MOVE

(75) Inventors: Per Wahlberg, Nacka (SE); Kennet Lejnell, Ekerö (SE)

(73) Assignee: OverHorizon (Cyprus) PLC, Nicosia (CY)

( * ) Notice: Subject to any disclaimer, the term of this patent is extended or adjusted under 35 U.S.C. 154(b) by 301 days.

(21) Appl. No.: 12/669,265

(22) PCT Filed: Sep. 12, 2008

(86) PCT No.: PCT/EP2008/007548

§ 371 (c)(1), (2), (4) Date: Jan. 15, 2010

(87) PCT Pub. No.: WO2009/039998

PCT Pub. Date: Apr. 2, 2009

(65) Prior Publication Data

US 2010/0207834 A1 Aug. 19, 2010

Related U.S. Application Data

(60) Provisional application No. 60/972,173, filed on Sep. 13, 2007.

(51) Int. Cl.
*H01Q 3/00* (2006.01)

(52) U.S. Cl. ..... 343/762; 343/757; 343/765; 343/882

(58) Field of Classification Search ..... 343/757, 343/762, 765, 786, 882, 711, 713
See application file for complete search history.

(56) References Cited

U.S. PATENT DOCUMENTS

| | | | | |
|---|---|---|---|---|
| 4,345,256 | A | 8/1982 | Rainwater | |
| 5,398,035 | A * | 3/1995 | Densmore et al. | 343/713 |
| 6,538,612 | B1 | 3/2003 | King | |
| 6,653,981 | B2 * | 11/2003 | Wang et al. | 343/713 |
| 7,173,571 | B2 * | 2/2007 | Webb et al. | 343/766 |
| 7,705,793 | B2 * | 4/2010 | Kaplan et al. | 343/713 |
| 2005/0259021 | A1 * | 11/2005 | Stoyanov et al. | 343/757 |

FOREIGN PATENT DOCUMENTS

| | | |
|---|---|---|
| JP | 62 084604 | 4/1987 |
| JP | 09 153718 | 6/1997 |
| JP | 10 178313 | 6/1998 |
| JP | 2001 0077637 | 1/2001 |
| WO | WO 2007/064094 | 6/2007 |
| WO | WO 2007/067016 | 6/2007 |

* cited by examiner

*Primary Examiner* — Hoang V Nguyen
(74) *Attorney, Agent, or Firm* — White & Case LLP

(57) ABSTRACT

A small antenna system for communications on-the-move ("COTM") with a geostationary or geosynchronous satellite to and from a land mobile, maritime or airborne vehicle is disclosed. The antenna system provides a robust and simple means of establishing communications with a satellite or remote computer device. Further embodiments of systems and methods of the various aspects of the present invention mitigate RF losses customary in existing horn antennas. Embodiments also facilitate COTM by utilizing novel antenna configurations that tightly integrate RF electronics while dissipating generated heat via an antenna compartment that may be designed to function as or be used in conjunction with a heat sink.

37 Claims, 8 Drawing Sheets

ANTENNA SYSTEM FOR COMMUNICATIONS ON-THE-MOVE

This application claims the priority benefit of U.S. provisional patent application Ser. No. 60/972,173, filed on Sep. 13, 2007, the contents of which are incorporated herein in their entirety by reference.

FIELD OF THE INVENTION

This invention relates to antenna systems for satellite communications.

BACKGROUND OF THE INVENTION

Operating satellite communications on-the-move ("COTM") requires an antenna system that is compact and reliable in order to facilitate mobile field operations. FIG. 1 illustrates the principal building blocks of a conventional on-the-move terminal. FIG. 1 shows an arrangement of parts typically used to form an on-the-move terminal for satellite communications. Here the antenna is housed inside the radome, and the RF box connected to this radome is the transmitter.

In a traditional reflector antenna, a horn illuminates the reflector surface. To minimize the spill-over effect, the horn is adjusted such that the intensity gradually decreases towards the edges. This condition leads to lower efficiency in terms of gain relative to surface area. There is also the blocking effect of mechanical obstacles that reduces the effective illumination of the surface area. Reflection on the surface itself will also decrease the efficiency due to surface irregularities and other factors, thereby leading to typical reflector efficiencies (defined in percent as the antenna gain relative to the calculated antenna gain for an antenna with the same area with zero losses) in the order of 50-80% depending on geometry, whereas the horn antenna typically will have an efficiency of 80-90%. As the aperture dimension decreases, it becomes more difficult to maintain a high efficiency in the reflector system. This is a result of the fact that illumination problems, irregularities, and blockage effects stay roughly constant while the reflector surface area decreases. Typically the efficiency is hard to keep above 50% as the ratio $D/\lambda \sim 25$, where D is the diameter of a circular antenna and $\lambda$ is the wavelength.

A typical horn is illustrated in FIG. 2. The illustration shows a horn antenna for Ku-band frequencies. The signal is fed into the antenna on the flange to the right in the figure, and is formed along the horn aperture to the antenna interface on the left.

There is, therefore, an increasing but unmet demand for a small antenna system for COTM with a geostationary or geosynchronous satellite to and from a land mobile, maritime or airborne vehicle that can improve system robustness and simplify handling and integration on the vehicle.

SUMMARY OF THE INVENTION

The present invention is designed to address the above-mentioned needs. Embodiments of the present invention utilize a small antenna system for COTM in communication with a geostationary or geosynchronous satellite to and from a land mobile, maritime or airborne vehicle. The invention can improve the robustness of the system, and simplify handling and integration on the vehicle. The use of a high efficiency antenna also permits the use of a smaller aperture than required in a traditional reflector design.

Embodiments of systems and methods of the various aspects of the present invention mitigate (i.e., prevent, minimize, or otherwise diminish) RF losses customary in existing horn antennas. Embodiments also facilitate COTM by utilizing novel antenna configurations that tightly integrate RF (radio frequency) electronics while dissipating generated heat via an antenna compartment designed to function as a heat sink.

According to an embodiment of an aspect of the present invention, the antenna system comprises an antenna which receives signals from and transmits signals to a satellite. The antenna is powered by a power source, which may be a battery, conventional power line, generator, or other device. The antenna system also comprises radio frequency ("RF") circuitry in communication with the antenna. The RF circuitry may comprise (a) a low-noise block ("LNB") for receiving satellite signals; (b) a block up-converter ("BUC") for transmission of satellite signals; and (c) a solid state power amplifier ("SSPA") for amplifying received and transmitted signals. Any of these electronic or radiofrequency circuitry components may have any particular shape or configuration. In one embodiment, the LNB has dimensions of 100×30×20 mm, and the BUC/SSPA has dimensions of 100×80×25 mm. Examples of LNBs that may be used with the present invention are available from New Japan Radio Co., Ltd., model nos. NJR2535SC, NJR2536SC, and NJR2537SC. Examples of BUCs with components that may be used with the present invention are available from New Japan Radio Co., Ltd., model no. NJT5025/25F, and SNXP Ltd. In an embodiment of the invention, the RF electronics will be approximately 100×70×20 mm in size in order to minimize the amount of space necessary.

The antenna system may also comprise a global positioning unit for determining the location of the antenna system on the globe, and a robotic steering unit for adjusting or optimizing the position of the antenna in relation to the satellite. The antenna system may also comprise a waveguide complex connected to the RF circuitry and comprising a filter and an orthomode transducer.

The antenna system may also comprise an interface panel comprising one or more sockets for connection to an external device.

The antenna may be any kind of antenna which collects and transmits RF signals. According to one embodiment of the invention, the antenna may be a horn antenna. An example of a horn antenna that may be used with the present invention is available from Flann Microwave Ltd., model no. 27820-P. Other types of antennas, such as parabolic antennas or aerial antennas, are also within the scope of the invention. The antenna may operate on any convenient or suitable frequency band, such as the Ku-band or higher frequency bands. In one embodiment, the antenna system utilizes a horn antenna having a diameter of about 15 cm and a length of about 15 cm, although in other embodiments, the antenna may be larger or smaller.

The interface panel may connect the antenna system to any type of device that can receive or send electronic signals. For example, the interface panel may connect to a modem, computer, or computer network interface device. This connection may be facilitated by one or more sockets on the interface panel for allowing the user to plug in any number of devices. The sockets may be conventional, such as RJ11 sockets, telephone interface connections, Ethernet sockets, RCA sockets, serial ports, parallel ports, USB ports, or other kinds of connections without limitation, or the sockets may be proprietary to the manufacturer. The sockets and connectors may be weatherproof to prevent humidity, rain, or other elements from entering into interface panel and causing the antenna system to deteriorate. For example, the sockets and connectors may have military or similar weatherproof connectors.

The interface panel may have a LAN or data connector socket or port which is used to control the motors and sensors of the antenna system.

In another embodiment of the invention, the antenna may be separately moveable with respect to the antenna system, while the remaining components are stationary. For example, the antenna may be equipped with a mechanism for turning the antenna and waveguide connection around its center axis to achieve a polarization twist around the beam bore sight, while the other components of the antenna system remain stationary. Such an embodiment permits the antenna system to be mounted on a surface and the antenna to be moved in an optimum position in relation to an orbiting satellite or other receiver/transmitter.

In another embodiment, the antenna system is mounted to a base to support the antenna. The base may be any kind of support structure which provides stability and rigidity to the antenna. Some or all of the associated RF circuitry may be located within a compartment adjacent to the antenna or in the base. The RF circuitry may be integrated into a single unit (e.g., a single chipset or chip scale package). The single unit may also be any number of chips or other electronic devices which are packaged into a single element for ease of handling. In another embodiment, the base is adjustable or rotatable and may function as a turntable to allow for optimum positioning of the antenna or antenna system in relation to an orbiting satellite or other receiver/transmitter.

The antenna may be manufactured from any conventional materials without limitation, such as metals, composites, plastics, or combinations thereof. In one embodiment, the antenna is manufactured from a thermally conductive material which allows for the dissipation of heat. In another embodiment, the antenna is manufactured from non-conducting (electrical) material, such as plastic, and the surface is covered by a thin layer of an electrically conductive material (e.g., a thin silver layer).

To permit further dissipation of heat, the antenna or antenna system may be equipped with a cooling fin assembly or a fan or a combination thereof. The cooling fin assembly may be affixed to the antenna and may function as a heat sink for removal of heat from other parts of the electronics in the antenna system. In yet another embodiment, the antenna may be constructed with a compartment adjacent to the antenna, and this compartment may house some or all of the RF circuitry associated with the antenna system. Accordingly, in this embodiment, the RF circuitry is sheathed and protected by the cooling fin assembly which also functions to remove heat from the electronics. Other means for cooling the antenna system or its component circuitry are within the scope of the invention.

In another embodiment of the invention, the power source may comprise one or more solar cells to provide power to the antenna system. These solar cells may be mounted on any convenient surface which can collect light, such as on the antenna. A battery may store any excess power generated by the solar cells.

In yet another embodiment, the antenna may be sealed by a cover which is transparent to RF signals. This cover replaces the need for a radome in a traditional antenna system, and prevents humidity, dust, and other environmental elements from entering into and damaging or deteriorating the antenna.

In a further embodiment, the robotic steering unit may be configured to optimize the position of the antenna system in relation to the satellite. The robotic steering unit may comprise an azimuth drive, an elevation motor drive, an inclinometer, and/or a bearing detector. In the case of equipment failure, the robotic steering unit may also have means for manually moving the antenna or antenna system into a desirable position. Such means may include a hand lever, compass, or other device(s) that would allow the operator to manually position the antenna or antenna system. Examples of such devices are known in the art.

The antenna system may send and receive signals from any kind of remote device, such as a remote computer. The remote device may be a satellite having computer capabilities to communicate with the antenna system. The remote device may be another antenna system that relays signals to extend its range across the region or over the entire globe. The antenna system may be in wireless communication with the remote computer. In other embodiments, the antenna system may be connected to the remote computer or other device via a wired connection, such as a cable, coaxial cable, computer cable, or fiber optics cable.

In yet a further embodiment of an aspect of the present invention, the antenna system may comprise a modem configured to communicate with the interface panel. In one embodiment, the modem may be configured to communicate via a fibre optic connection whereby all signals are transformed to fiber optic signals from the interface panel and back to their original shape to the antenna compartment. This embodiment is advantageous for antenna systems with challenging installations because it provides for a digital/analogue fibre interface that carries transmit/receive RF signals at L-band or UHF, and digital signals for monitor and control or antenna control all on the same fibres. For example, signals received on the sockets in the interface panel coming from, say, a modem and computer (i.e., both the L-band signal and the computer digital signals) are all bundled together and transmitted from the socket up to the antenna compartment through a fibre optic connection. This may resolve the problem of getting all the different signals through the rotating axis when the antenna is rotating to keep track of the satellite. It is much easier to transmit in one cable (fibre optic) than to use all connectors necessary to connect the control signal and L-band signals through a rotating axis (a standard cable will break in this environment).

The modem may be any kind of device which converts digital signals to analog signals and vice versa, or the modem may convert electronic signals to radiofrequency signals. The modem may transmit signals via electronic pulses, microwaves, WiFi, or any other convenient means to the remote device, such as a remote computer, satellite, or relay antenna. Examples of modems that may be used with the present invention are available from STM Group, Inc., model no. SatLink 1910 Maritime, and Advantech Satellite Networks, model no. 55200, or any other standard satellite modem.

The antenna system may be directly or indirectly connected to a standard computer which contains computer software for controlling and/or receiving data or other communications services from the antenna system. The controlling computer may be a remote computer or a local computer running conventional software, such as Windows™, Unix™, Macintosh™, or other programs or operating systems.

In another embodiment of an aspect of the present invention, the antenna system comprises a plurality of antennas electrically connected to the electronic circuitry. The plurality of antennas may be connected via a back plane feed array, which may comprise one or more RF phase combiners, one or more RF phase splitters, or combinations of both. The plurality of antennas may also be joined together via a mechanical strap-on device.

Another aspect of the invention provides a method of providing on-the-move communications with a satellite. In one embodiment, the method may comprise the steps of providing the disclosed antenna system; establishing the geographical location of the antenna system in relation to an orbiting satellite (or other remote or relay device) using the global positioning system; optimizing the position of the antenna in relation to the satellite using the robotic steering unit; and receiving signals from the satellite and transmitting signals to the satellite.

The method may also comprise the step of stabilizing the antenna system, for example, using a gyroscope. The antenna system may be mounted to a platform, and the gyroscope configured to detect mechanical movement of the antenna system or the platform. In one embodiment, the gyroscope is a fibre optic gyroscope.

The inventive antenna system can be readily utilized in on-the-move situations which utilize low-profile antennas; in on-the-pause situations which utilize manpack antennas for personal or field communications; in-the-air situations which utilize maimed and unmanned aeronautical vehicles and planes; and in-the-sea environments in a variety of maritime platforms, such as naval, global freight, and cruise ships.

The antenna system can be used to transmit any kind of signals, such as secure and non-secure high resolution real time video/audio communications, voice-over-internet protocol ("VoIP"), video conferencing, data file transfer, and data communications.

Advantageously, the inventive antenna system permits rapid communications between physically unconnected computers and remote devices. For example, the antenna system allows for high-throughput of data in real time. The costs of the inventive antenna systems are also less than those for other antenna systems.

The antenna system may be sold or leased to end users. The antenna system may optionally be bundled with communications services, such as data transfer capabilities via satellite.

The antenna system may also be used in conjunction with the following commonly assigned and copending U.S. patent applications: Ser. No. 11/623,799, entitled "Systems and Methods for Satellite Communications with Mobile Terrestrial Terminals"; Ser. No. 11/623,821, entitled "Systems and Methods for Establishing Modular and Flexible Satellite Communications Networks"; Ser. No. 11/623,877, entitled "Systems and Methods for Collecting and Processing Satellite Communications Network Usage Information"; Ser. No. 11/623,902, entitled "Systems and Methods for Tracking Mobile Terrestrial Terminals for Satellite Communications"; and Ser. No. 11/623,986, entitled "Systems and Methods for Communicating with Satellites via Non-Compliant Antennas", all filed on Jan. 17, 2007; and Ser. No. 11/779,228, entitled "Systems and Methods for Mobile Satellite Communications", and Ser. No. 11/779,242, entitled "Systems and Methods for Mitigating Radio Relay Link Interference in Mobile Satellite Communications", both filed on Jul. 17, 2007; and any international applications claiming the benefit of or priority to these applications, all such applications being incorporated herein by reference in their entirety.

Other methods of COTM may be facilitated with embodiments of the present invention, as will be evident from the specification below.

BRIEF DESCRIPTION OF THE DRAWINGS

Various aspects of the systems and methods according to the present invention are described in the figures identified below and in the detailed description that follows.

DETAILED DESCRIPTION

This description, including the figures, describes embodiments that illustrate various aspects of the present invention. These embodiments are not intended to, and do not, limit the scope of the invention to particular details.

The present invention describes a small terminal used for COTM in communication with a geostationary or geosynchronous satellite to and from a land mobile, maritime or airborne vehicle. Various embodiments of aspects of the invention may improve system robustness and simplify handling and integration on the vehicle. The use of a high efficiency antenna makes it possible to use a smaller aperture than required in a traditional reflector design.

Figure 1:
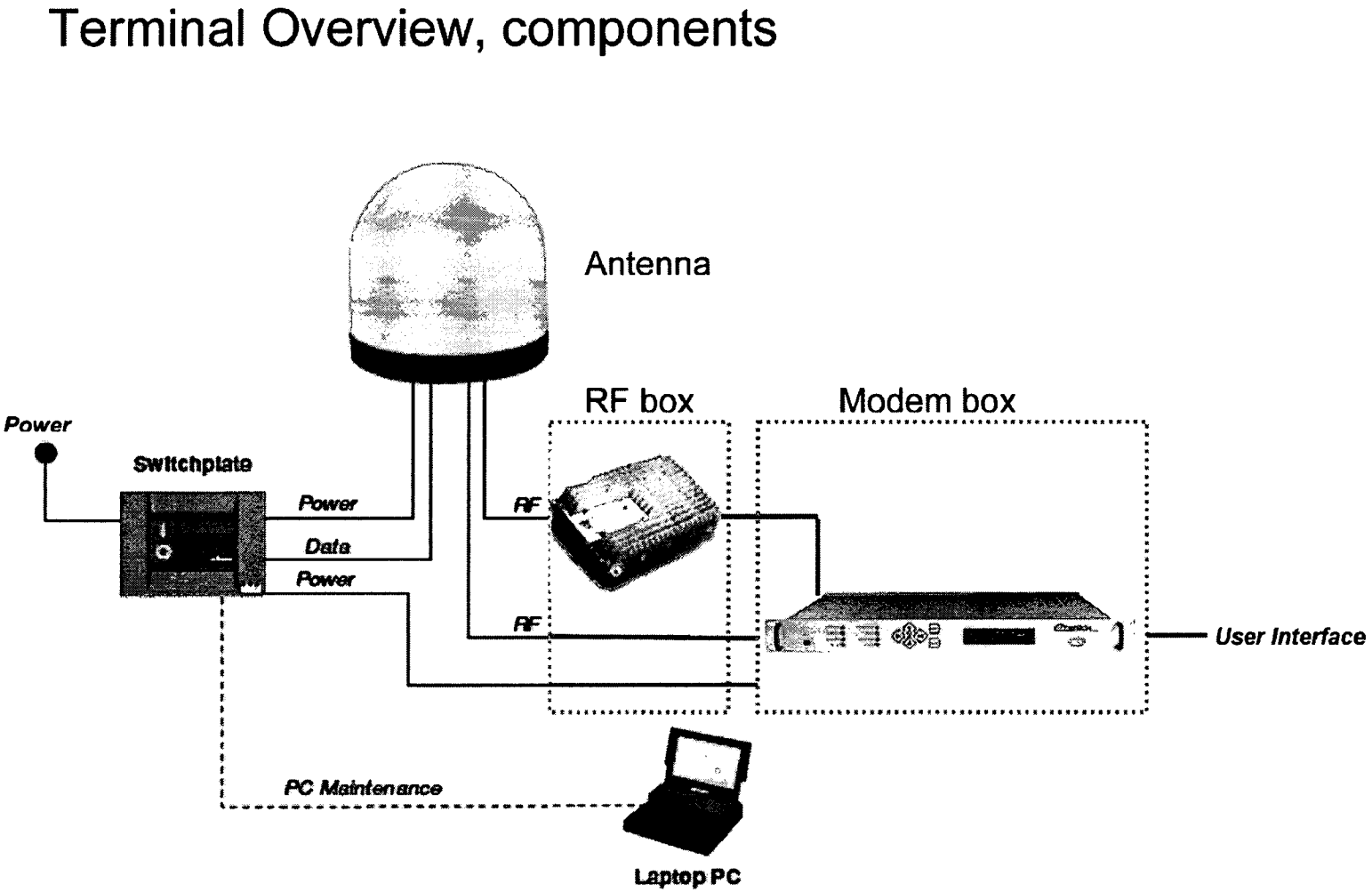
FIG. 1 shows the principal building blocks of a conventional on-the-move terminal.

The features of the invention include, but are not limited to, the following highlights:

- Highly efficient antenna system to minimize system size;
- Minimization of RF losses internal to the system will reduce the required input power to the system and increase the system sensitivity (G/T defines the antenna system ability to separate a signal from the background noise, where G is the antenna gain and T is the system noise figure);
- The autonomous antenna and RF unit include robotic steering for continuous pointing towards the satellite. For this purpose, a GPS unit is included and is integrated at a predetermined position on the vehicle or as a stand alone unit;
- The autonomous parts have simple connections that make it easy to install and remove the apparatus, for example, if the system must be moved from one vehicle platform to another, or even operated as a portable manpack unit without the vehicle.
- The tight integration of RF electronics in the antenna compartment enables sealing all RF components from the environment. In principle, the radome in a traditional system (as shown in FIG. 1) is replaced with the front cover on the horn. This can provide a substantial weight reduction since radomes are heavy.

In the present invention, a reflector is not necessary. Accordingly, in one embodiment, a highly efficient horn antenna is used as the antenna. The resulting system is small, highly efficient, and robust with simple mechanical characteristics. This approach is feasible when the ratio $D/\lambda$, is small, typically of the order of 10 and below 25, and can be used for satellite communication systems where the required antenna gain is low. As an example, antenna diameters needed in order to achieve an gain of 32.0 dBi at 13 GHz for different efficiencies are provided in the following table:

| Antenna efficiency | Antenna diameter |
|---|---|
| 90% | 31 cm |
| 70% | 35 cm |
| 50% | 41.5 cm |

Minimizing system losses can help to improve the overall system efficiency of the antenna system. To be able to do this, one of the most important factors is to limit the physical distance between components operating at high frequency (transmit and receive frequencies); when the frequency is transformed down to L-band, the signal is no longer that susceptible to losses and may be transferred over longer distances in cables without substantial loss in signal quality. In one embodiment, the present invention uses L-band signals to transmit the signals from the modem to the antenna to address losses of signal quality before the signals are transmitted from the antenna.

Figure 3:
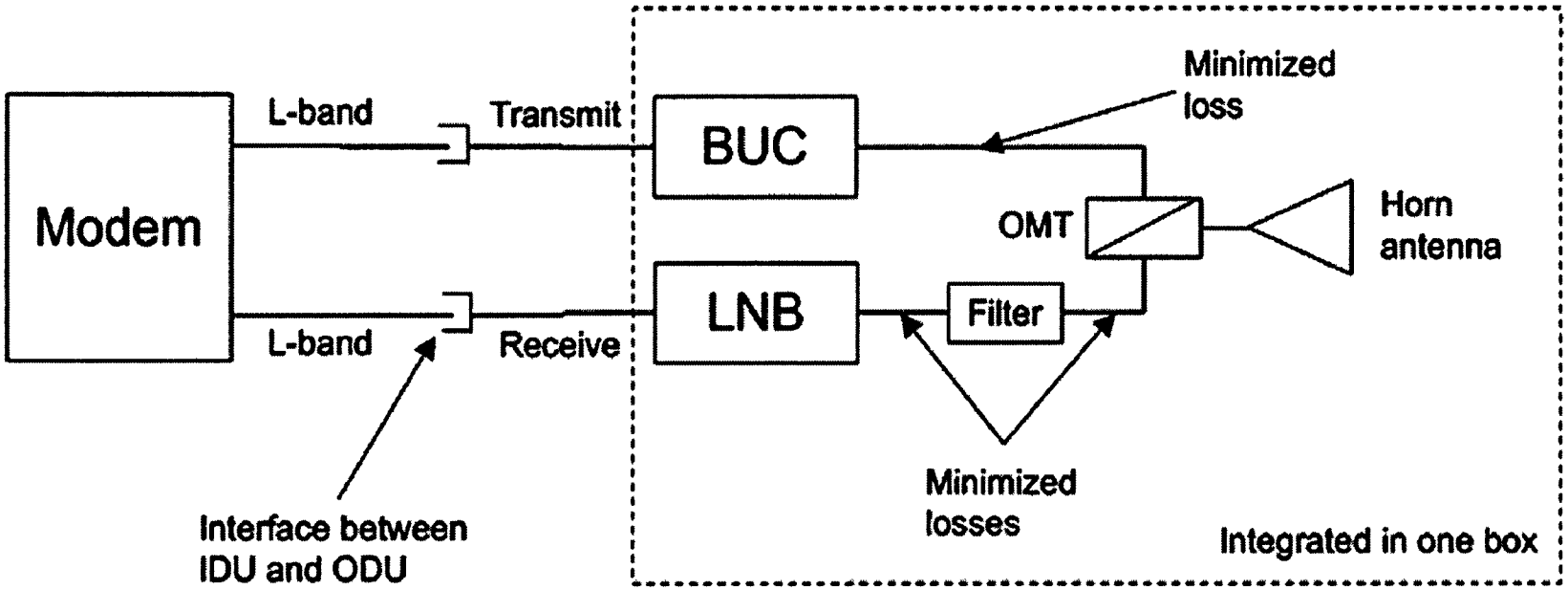
FIG. 3 shows an block diagram of RF circuitry which may be used in the present invention.

FIG. 3 shows an RF block diagram with the main blocks that are used for the functionality as a radio transmitter. An important feature in the design is to minimize the distance between the BUC/SSPA (block up-converter+solid state power amplifier) and OMT (ortho mode transducer) as well as LNB (low-noise block) to filter and filter to OMT distance. In one embodiment, these blocks are integrated into one unit, hence diminishing the distance to zero. This will minimize the total losses in the system and results in higher receive sensitivity (G/T) and higher transmit EIRP (equivalent isotropically radiated power) for a given total input power to the system. In the figure, IDU represents In-Door Units, referring to the particular equipment typically placed inside a building, and ODU represents Out-Door Units, referring to the particular equipment which is typically placed outside of the building.

Figure 4:
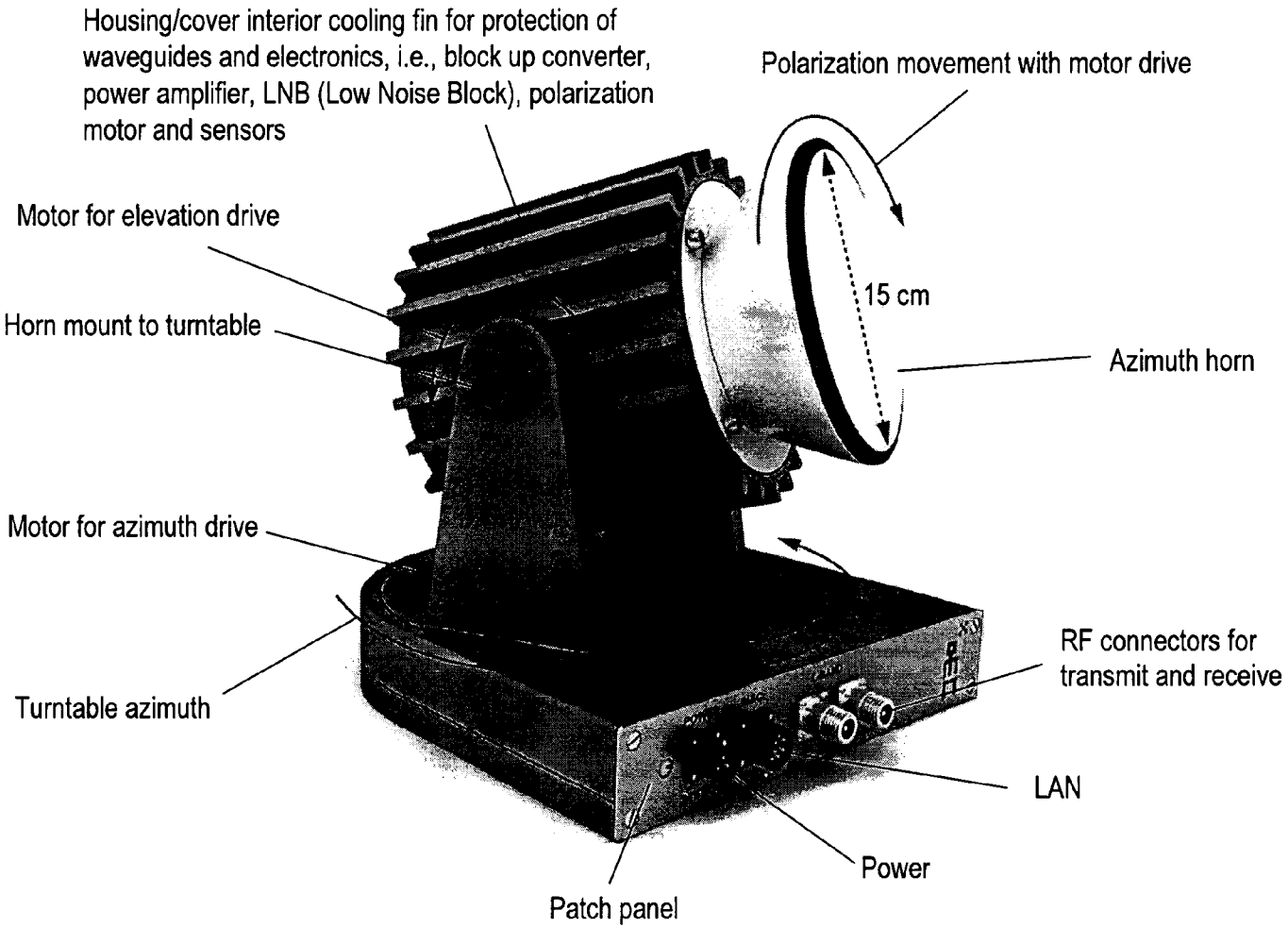
FIG. 4 shows an embodiment of the antenna system according to the present invention.

The antenna can be manufactured with a compartment for housing the electronics and ODU RF parts associated with the antenna system. This is illustrated in FIG. 4 where the complete system from the L-band interface is housed inside an environmentally sealed and thermally cooled compartment. The compartment can be located as a continuation from the horn front part as depicted in the embodiment illustrated in FIG. 4, for example, or in other embodiments on the back of the antenna towards the input interface or within the antenna system turntable. In the embodiment illustrated in FIG. 4, the front of a horn antenna is environmentally sealed by a cover that allows the RF signals to pass through (with minimal loss and effect on the signals). This makes it possible to seal all parts without interfaces, thereby protecting the electronics and the antenna front end. In this regard, interfaces are difficult to keep tightly sealed, hence the fewer interfaces present, the lower the risk for problems with humidity and pollution entering inside the sensitive waveguide system and RF components.

Figure 2:
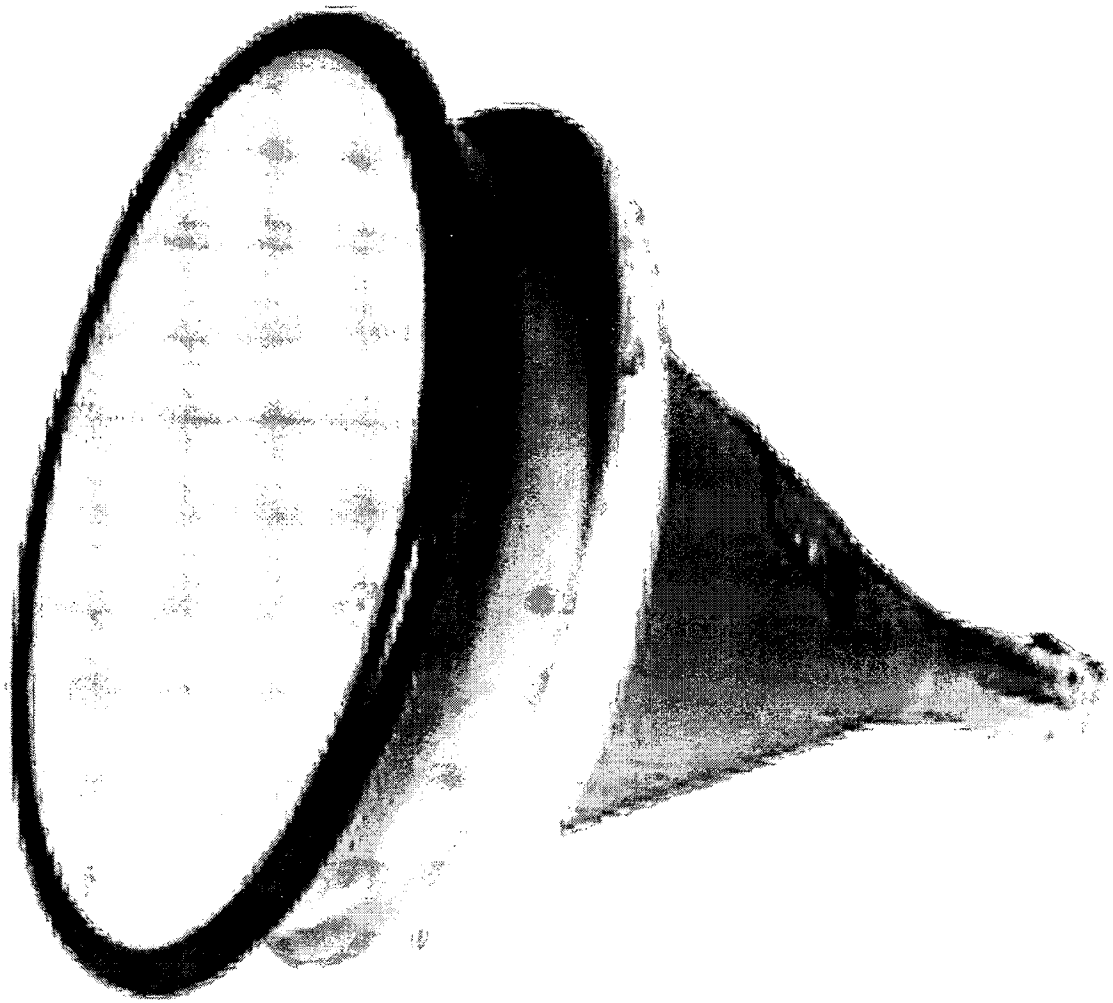
FIG. 2 shows an example of a typical horn antenna.

The antenna system in FIG. 4 can utilize the horn shown in FIG. 2, but is not limited to that particular mechanical design. The connectors or sockets shown on the front panel of FIG. 4 are RF transmit and receive signals (L-band), power, and data signals (for steering and control purposes). In one embodiment, the L-band is used to transfer signals from the modem up to the antenna unit and the BUC where the signals are transformed to Ku-band. Received signals are transformed from Ku-band down to L-band via the LNB.

FIG. 4 illustrates an aspect of the principal functionality and integration of the invention. In FIG. 4, the following elements are included: horn antenna; (a) the horn mounting mechanism towards the turntable; (b) turntable including azimuth and elevation motor drives with counters as well as an inclinometer (for tilt measurements) and a bearing detector (for determination of azimuth alignment relative to the space craft/satellite); (c) a "covering compartment" covering the surface of the horn antenna in the form of a cooling fin (heat sink) for optimal thermal cooling of electronic components inside this compartment; (d) waveguide complex that includes OMT and filter functionality; (e) RF electronics (BUC/SSPA and LNB) in connection with the waveguide complex; (f) a mechanism for turning the antenna and waveguide connection around its center axis to achieve a polarization twist around the beam bore sight; (g) a patch panel in the turntable mechanical plate for the necessary connectors including the RF signals on L-band, the power and the data, control and steering signals to and from the sensors and motor drive (TX/Transmit and RX/Receive); and (h) a polarization drive motor mechanism. These components can be seen on the visible exterior of the antenna system or can be placed inside a compartment within the housing/cover with cooling fins or in the base.

The antenna mount may consist of two or more components or parts which provide means for mounting the antenna to the base. One of the mounts may move or rotate the antenna in one direction and another mount may move the antenna in another or the opposite direction to the first mount. Alternatively, all of the mounts may move the antenna in all directions.

Figure 5:
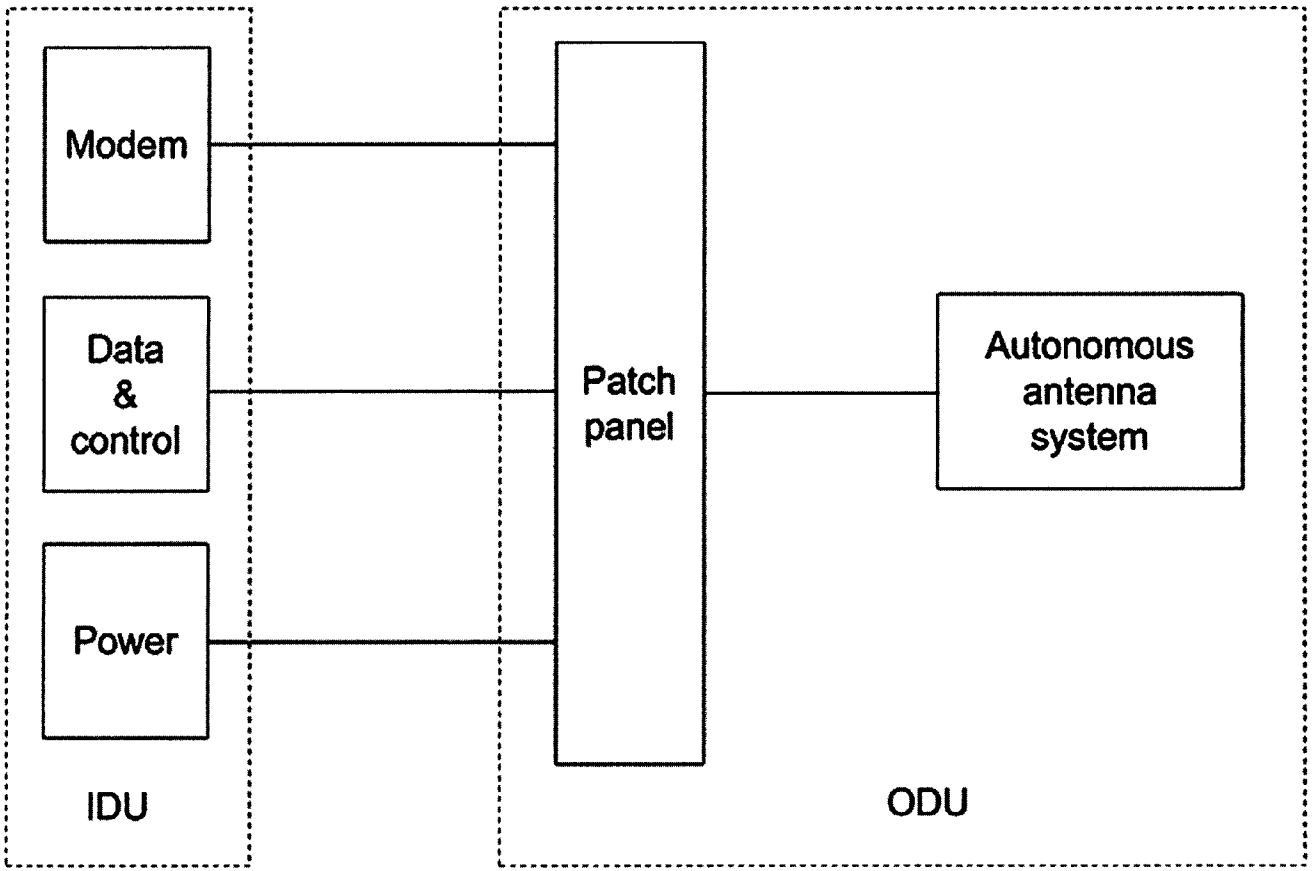
FIG. 5 shows a block diagram of an aspect of the principal functionality and integration of an embodiment of the invention.

As shown in FIG. 4, the antenna will house all or most of the necessary functionality to serve as an autonomous transmitter. FIG. 5 is a simplified view of FIG. 4 and shows the principal building blocks of the system.

In known systems for on-the-move communications, it is difficult to place equipment inside a compartment as described (i.e., inside the radome), or to transfer heat out of one. An amplifier with high RF power and low efficiency (e.g., for 10 W RF requires approx. 100 W input) needs more power to operate, and hence must be cooled. This cooling can be particularly problematic in desert-like regions. Therefore, an amplifier is used and is typically placed in a completely separate and distinct location from the antenna. However, the system experiences losses in signal as they travel from the amplifier to the antenna. For example, a cable results in 1-2 dB loss per meter of cable at Ku-band frequencies and hence a ~1.5-3 m cable will result in a 3 dB loss between the amplifier and the antenna, reducing the useful RF power to half.

The present invention can address this deficiency by optionally providing a built-in cooling fin arrangement on the satellite antenna to form a compartment. In one embodiment, this compartment can be a metal housing with room for an amplifier and other electronics. For example, the cooling fin can form or sheath a compartment which houses waveguides, block up converters, power amplifiers, low noise blocks, polarization motors, sensors, and other electronic components forming part of the antenna system. The cooling fin can be in any convenient shape or configuration, such as cylindrical, square, or rectangular, so as to mate with and remove heat from the antenna or other components of the system. In this manner, the size of the antenna system can be minimized.

If more efficient cooling is desired, the compartment may be fitted with additional cooling equipment such as an internal air-blowing fan.

In an alternative embodiment, a GPS unit is included and integrated in the antenna system, on the vehicle or as a standalone unit. However, if the GPS unit is offline or malfunctioning, a computer coupled to the terminal may be used to manually input the necessary coordinates, for example, to point the antenna towards a satellite. A computer is used to calculate the pointing vector towards the satellite and by comparing input from sensors (azimuth and elevation, compass bearing or true azimuth, inclination) a pointing correction is calculated, and then the correction commands are sent to the motors (azimuth, elevation and polarization motors). The antenna can optionally be manually manipulated into position if the GPS unit or robotics unit is offline.

Figure 6:
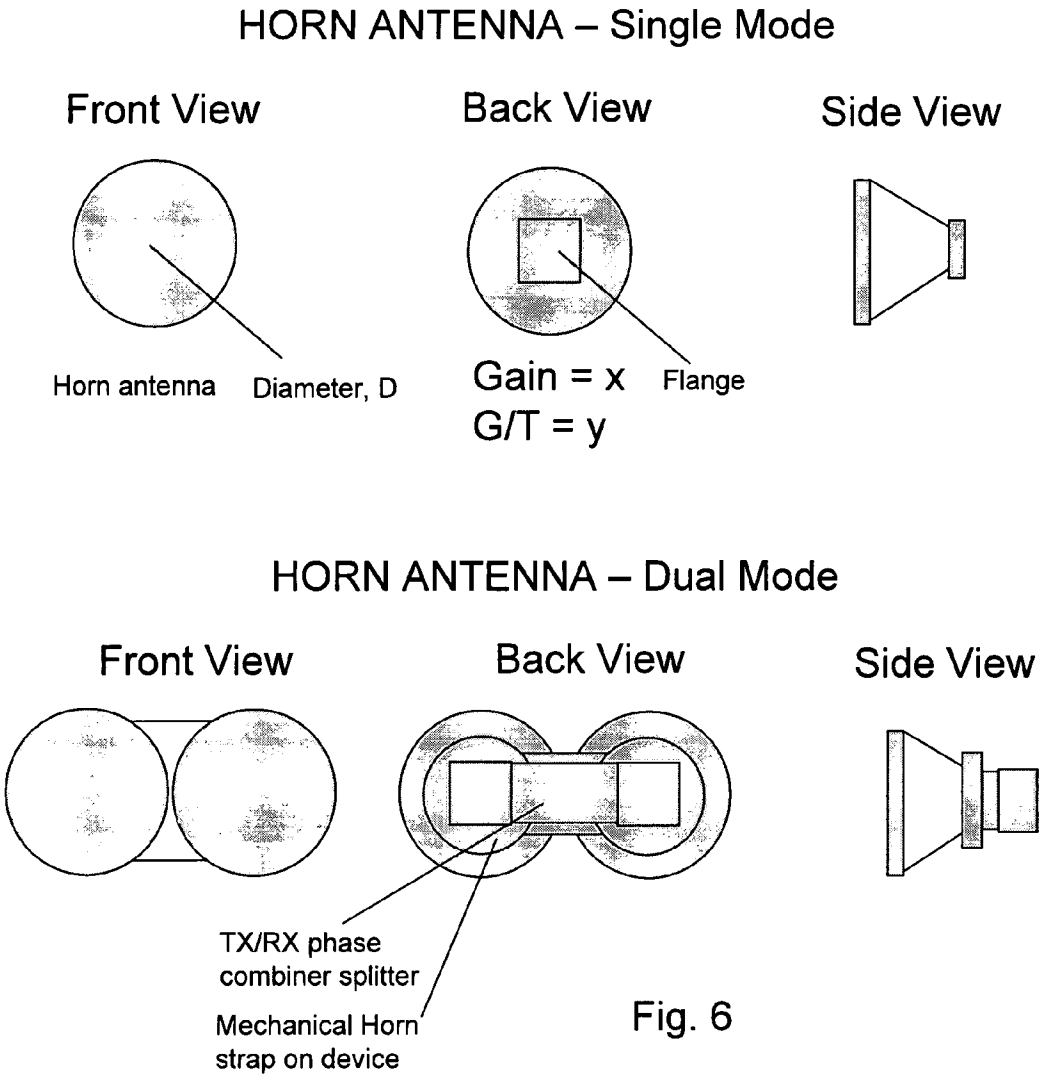
FIG. 6 shows an embodiment of the antenna system utilizing more than one antenna.
Figure 7:
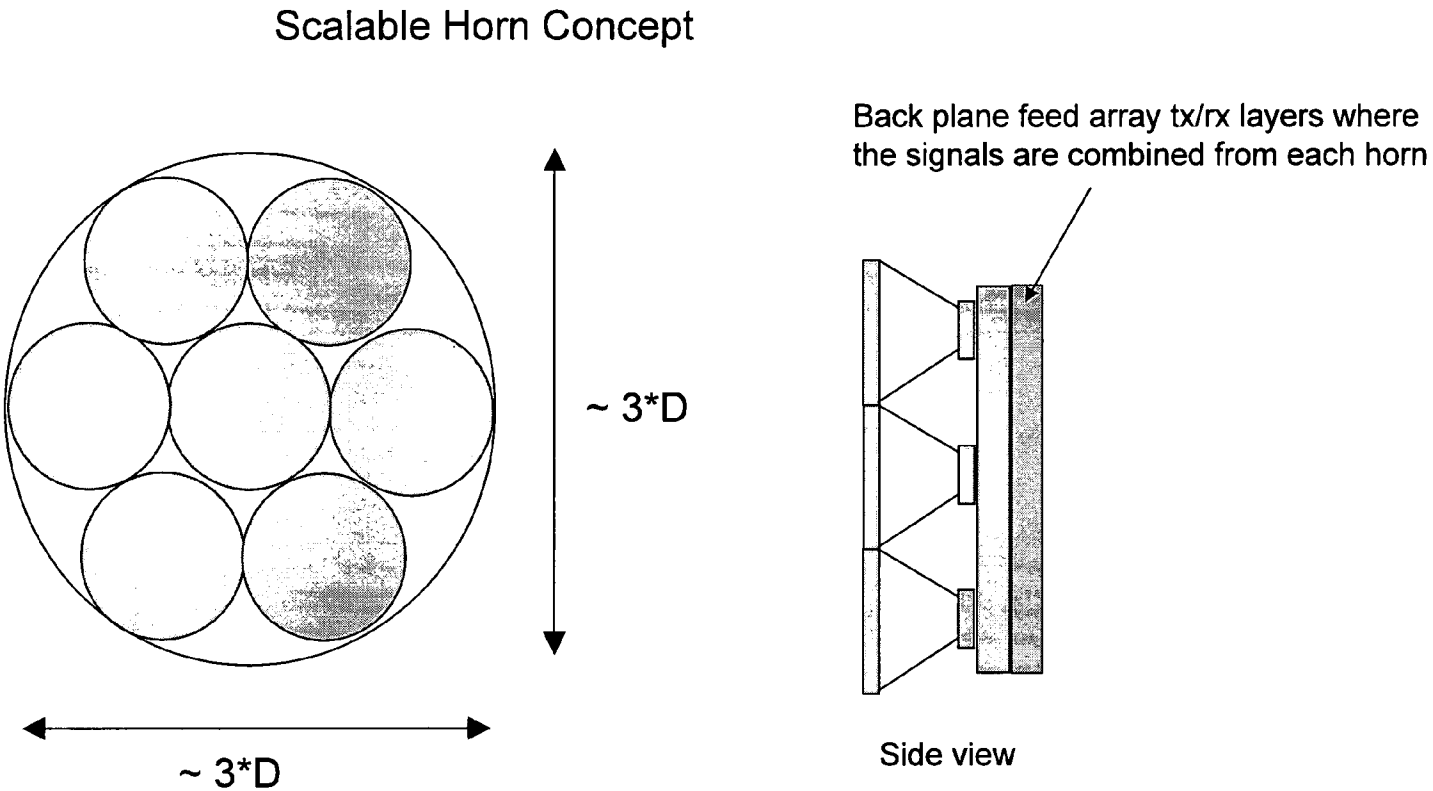
FIG. 7 shows another embodiment of the antenna system utilizing more than one antenna.

In another embodiment, the antenna system may be scalable by adding one or more antennas. As shown in FIGS. 6 and 7, a simple mechanical device including a RF phase combiner (feed network) allows for additional antennas to increase the overall Gain and G/T. The device can include a mechanical strap on that can be applied to up to 16 antennas using the described method.

A potential advantage of this embodiment allows for the length of the antenna system to be reduced. If the size of the horn is decreased, the corresponding loss in antenna gain will be compensated for by adding more horns and combining the signals from each horn. The result is a harmonized stronger signal.

According to this embodiment, adding one identical antenna will double the gain (i.e. a 3 dB increase) but some additional losses will also be inevitable:

$$\text{Gain}=x+3\text{ db}-\text{loss}$$

$$G/T=y+3\text{ db}-f(\text{loss, antenna noise})$$

where the f(loss, antenna noise) is a decreasing factor that depends on the loss in the feed network and changes of the received noise in the antenna depending on a change in antenna noise reception.

The general formula to calculate the new gain by combining N horn elements originating from the single horn gain x is:

$$\text{Gain}=x+10*\text{Log}(N)\text{db}-\text{loss}$$

$$G/T=y+10*\text{Log}(N)\text{db}-f(\text{loss, antenna noise})$$

where the f(loss, antenna noise) is a function giving the decreasing factor that depends on the losses in the feed network and the new antenna noise resulting from the tighter antenna lobe as described above.

Figure 8:
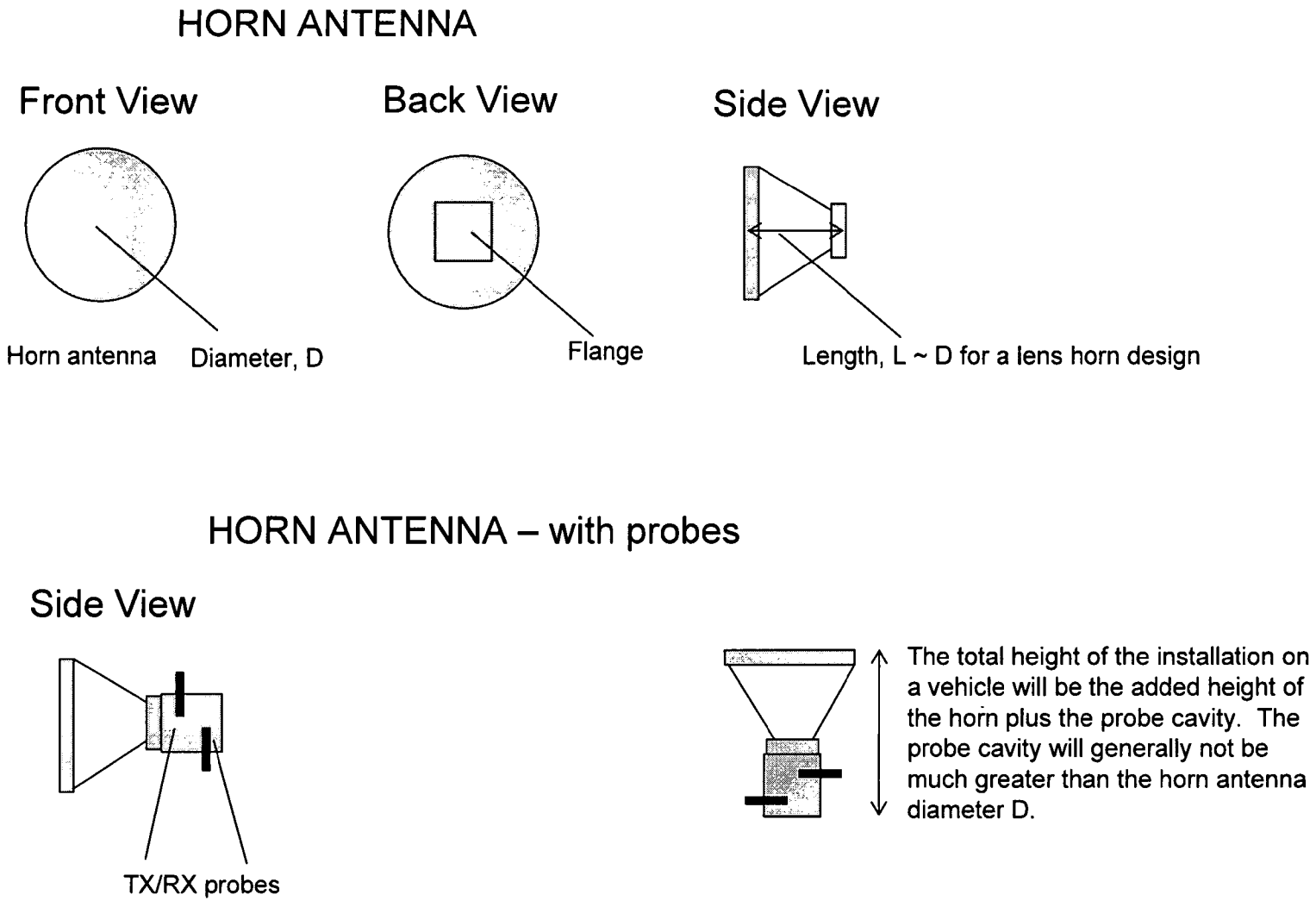
FIG. 8 shows a further embodiment of the antenna system according to the present invention.

According to another embodiment as illustrated in FIG. 8, the size of the antenna components may be decreased on its axial line by replacing some of the wave guide components with simpler probes, such as transmit (TX) and receive (RX) probes. This will inevitably lead to a decrease in performance, but can be compensated for by using a slightly larger horn diameter. In one embodiment, the overall length is decreased by approximately 6-8 cm (~3-4 wavelengths) while the diameter is increased by approximately 1-2 cm on the frequency band such as the Ku-band at 11-13 GHz.

According to another embodiment of the present invention, the antenna system uses wireless transmission of the modem signals and the control signals to the antenna unit. A modem with an IP interface and a WLAN connection is moved to the antenna housing, and the control signals are transmitted through the WLAN connection as well.

According to yet another embodiment, the heat generated within the antenna housing by the integrated electronics equipment is radiated with greater efficiency. In addition to standard cooling fins, the antenna or feed horn is manufactured from a thermal conductive material. In another embodiment, solar cells may be coupled to the rim of the horn housing in combination with a battery that may allow for low power operations or full power transmissions during short time periods. There may also be a standby mode during which no power is taken from the vehicle.

The various entities identified in the Figures and described herein may each utilize one or more computer processors, and the computer processors of each entity may be configured to communicate with the computer processors of one or more of the other entities in order to carry out the methods of the present invention.

Other objects, advantages and embodiments of the various aspects of the present invention will be apparent to those who are skilled in the field of the invention and are within the scope of the description and the accompanying figures. For example, but without limitation, structural or functional elements might be rearranged, or method steps reordered, consistent with the present invention. Similarly, various elements may comprise a single instance or a plurality of instances, such plurality possibly encompassing types of elements. The RF equipment described in various embodiments are not meant to limit the possible types of devices that may be used in embodiments of aspects of the present invention, and other types of equipment that may accomplish similar tasks may be implemented as well. Similarly, principles according to the present invention, and systems and methods that embody them, could be applied to other examples, which, even if not specifically described here in detail, would nevertheless be within the scope of the present invention.

What is claimed is:

1. An antenna system for on-the-move communications, the antenna system comprising:

an antenna which receives signals from and transmits signals to a satellite;

a power source;

electronic circuitry, the electronic circuitry comprising:

radio frequency (RF) circuitry in communication with the antenna, the RF circuitry comprising:

(a) a low-noise block (LNB) for receiving satellite signals;

(b) a block up-converter (BUC) for transmission of satellite signals; and (c) a solid state power amplifier (SSPA) for amplifying received and transmitted signals;

a global positioning unit for determining the location of the antenna system;

a robotic steering unit for adjusting the position of the antenna in relation to the satellite;

a waveguide complex connected to the RF circuitry and comprising a filter and an orthomode transducer; and an interface panel comprising one or more sockets for connection to an external device, wherein the RF circuitry and the waveguide complex are integrated into a single unit or housed inside one compartment of the antenna system.

2. The antenna system according to claim 1, wherein the antenna is a horn antenna.

3. The antenna system according to claim 1, wherein the external device is a modem, computer, or computer network interface device.

4. The antenna system according to claim 1, wherein the antenna is separately movable with respect to the antenna system.

5. The antenna system according to claim 1, wherein the compartment is a base which structurally supports the antenna.

6. The antenna system according to claim 5, wherein the base is adjustable or rotatable.

7. The antenna system according to claim 5, wherein the base is a turntable.

8. The antenna system according to claim 5, further comprising means for mounting the antenna to the base.

9. The antenna system according to claim 1, wherein the antenna is manufactured from a thermally conductive material.

10. The antenna system according to claim 1, further comprising a cooling fin assembly for removing heat from the antenna system.

11. The antenna system according to claim 10, wherein the cooling fin assembly is affixed to an outer surface of the antenna.

12. The antenna system according to claim 10, further comprising means for transferring heat from one or more components of the antenna system to the cooling fin assembly.

13. The antenna system according to claim 1, further comprising a fan for cooling electrical components of the antenna system.

14. The antenna system according to claim 1, wherein the power source comprises a solar cell for providing power to the antenna system.

15. The antenna system according to claim 14, wherein the solar cells are mounted on the antenna.

16. The antenna system according to claim 14, further comprising a battery for storing power generated by the solar cell.

17. The antenna system according to claim 1, wherein the front of the antenna is sealed by a cover which is transparent to RF signals.

18. The antenna system according to claim 1, wherein the robotic steering unit is configured to optimize the position of the antenna system in relation to the satellite.

19. The antenna system according to claim 1, wherein the robotic steering unit comprises an azimuth drive; an elevation motor drive; an inclinometer; and a bearing detector.

20. The antenna system according to claim 1, wherein the antenna system sends signals to and receives signals from a remote computer.

21. The antenna system according to claim 1, wherein the antenna system receives signals from the external device on the L-band and transmits signals towards the satellite on the Ku-band or on higher frequencies.

22. The antenna system according, to claim 1, wherein the single unit is a single chipset or chip scale package.

23. The antenna system according to claim 1, wherein the one or more sockets provide a connection to a local computer, a remote computer, or a network.

24. The antenna system according to claim 23, wherein the one or more sockets are configured to communicate with the local computer, remote computer, or network via a fibre optic connection.

25. The antenna system according to claim 1, wherein signals received on the one or more sockets are bundled together and transmitted from the socket up towards the antenna via a fibre optic connection.

26. The antenna system according to claim 1, further comprising a modem configured to communicate with the interface panel.

27. The antenna system according to claim 26, wherein the compartment is adjacent to the antenna in which the modem is also housed.

28. The antenna system according to claim 27, wherein the compartment is sheathed by a cooling fin assembly.

29. The antenna system according to claim 1, wherein the antenna system is in wireless communication with a computer.

30. The antenna system according to claim 1, wherein the antenna system comprises a plurality of antennas electrically connected to the electronic circuitry.

31. The antenna system according to claim 30, wherein the plurality of antennas is connected to the electronic circuitry via a back plane feed array.

32. The antenna system according to claim 31, wherein the back plane feed array comprises one or more RF phase combiners, one or more RF phase splitters, or combinations of both.

33. The antenna system according to claim 30, wherein the plurality of antennas are joined together via a mechanical strap on device.

34. The antenna system according to claim 1, wherein the electronic circuitry is in communication with the antenna via a fibre optic connection.

35. A method of providing on-the-move communications with a satellite, the method comprising:

(a) providing the antenna system according to claim 1;

(b) establishing the geographical location of the antenna system in relation to the satellite using the global positioning system;

(c) optimizing the position of the antenna in relation to the satellite using the robotic steering unit; and (d) receiving signals from the satellite and transmitting signals to the satellite.

36. The method according to claim 35, further comprising the step of stabilizing the antenna system by configuring a gyroscope to detect mechanical movement.

37. The method according to claim 36, wherein the gyroscope is a fibre optic gyroscope.

* * * * *